US008939807B2

(12) United States Patent
Jones et al.

(10) Patent No.: US 8,939,807 B2
(45) Date of Patent: Jan. 27, 2015

(54) PROPELLER PROTECTION APPARATUS

(71) Applicants: Bartley D. Jones, Mound, MN (US); Steven R. Hendrickson, Burnsville, MN (US)

(72) Inventors: Bartley D. Jones, Mound, MN (US); Steven R. Hendrickson, Burnsville, MN (US)

( * ) Notice: Subject to any disclaimer, the term of this patent is extended or adjusted under 35 U.S.C. 154(b) by 127 days.

(21) Appl. No.: 13/743,387

(22) Filed: Jan. 17, 2013

(65) Prior Publication Data

US 2013/0189884 A1 Jul. 25, 2013

Related U.S. Application Data

(60) Provisional application No. 61/588,845, filed on Jan. 20, 2012.

(51) Int. Cl.
*B63H 25/02* (2006.01)
*B63H 5/16* (2006.01)

(52) U.S. Cl.
CPC ..... *B63H 25/02* (2013.01); *B63H 5/165* (2013.01); *B63H 2025/022* (2013.01)
USPC ..... 440/71

(58) Field of Classification Search
USPC ..... 440/71, 72; 280/47.131
See application file for complete search history.

(56) References Cited

U.S. PATENT DOCUMENTS

| | | | | |
|---|---|---|---|---|
| 2,711,152 | A * | 6/1955 | McGregor | 440/71 |
| 2,822,183 | A * | 2/1958 | Montgomery | 280/47.131 |
| 3,965,845 | A | 6/1976 | Lubov | |
| D245,844 | S | 9/1977 | Donat | |
| 4,570,960 | A * | 2/1986 | Peetz | 280/47.131 |
| 4,902,255 | A | 2/1990 | Faunda | |
| 5,344,346 | A | 9/1994 | Griffin | |
| 5,398,631 | A | 3/1995 | Miller | |
| 5,643,023 | A | 7/1997 | Sober | |
| 5,791,279 | A * | 8/1998 | Hart | 280/47.131 |
| 6,332,818 | B1 | 12/2001 | Duncan et al. | |
| 6,364,723 | B1 | 4/2002 | Hite | |
| 6,568,344 | B2 | 5/2003 | Burlet | |
| 6,669,516 | B1 | 12/2003 | Husted et al. | |
| 6,682,378 | B1 | 1/2004 | Day | |
| 7,291,047 | B1 | 11/2007 | Jones et al. | |
| 7,850,412 | B2 | 12/2010 | Benedict et al. | |
| 8,066,222 | B2 | 11/2011 | Lee et al. | |
| 8,091,501 | B2 | 1/2012 | Lazarevic | |
| 2004/0072480 | A1 | 4/2004 | Pither | |
| 2008/0096446 | A1 | 4/2008 | Lin | |

* cited by examiner

*Primary Examiner* — Lars A Olson
(74) *Attorney, Agent, or Firm* — Mitchell A. Rossman; Terra Nova Patent Law, PLLC

(57) ABSTRACT

The present invention provides propeller protection apparatus surrounding a turnable propeller assembly operating beneath a bottom hull of a watercraft. The propeller protection apparatus includes one or more deflecting members; one or more support members; one or more removable axles; and two or more removable wheels.

7 Claims, 10 Drawing Sheets

PROPELLER PROTECTION APPARATUS

RELATED APPLICATIONS

This application claims priority to U.S. Provisional Patent Application Ser. No. 61/588,845 filed Jan. 20, 2012, which is hereby incorporated by reference in its entirety for all purposes.

BACKGROUND OF THE INVENTION

Propeller damage from beaching a small watercraft is typically avoided by tilting or trimming the outboard or inboard/outboard motor so the propeller is raised up above the plane of the hull bottom. For non-trimmable motors, beaching protection for the propeller may take the form of a simple bracket, a skeg, a kort nozzle, a tunneled hull, or a similar cavity or appendage.

Weed entanglement for non-trimmable motors on small watercraft has traditionally been avoided by use of a leading skeg, a deflecting sheath, a mesh, a screen, a grate device, or the like.

Small watercrafts are typically transported over land by wheeled carts, dolleys, trailers, wheels affixed to the watercraft, or the like. Small watercrafts are typically stored in a horizontal position on a trailer or a cradle. This horizontal position requires more floor space than vertical storage. However, typical vertical storage requires a solid surface or structure for leaning the small watercraft against.

What is needed is a simple system that solves all of these problems.

SUMMARY OF THE INVENTION

The present invention provides a propeller protection apparatus surrounding a turnable propeller assembly operating beneath a bottom hull of a watercraft. The propeller protection apparatus includes one or more deflecting members, each of which extend below the lowest point of the watercraft's propeller path. Affixed between the one or more deflecting members are one or more support members. The one or more deflecting members and the one or more support members act to prevent the propeller from being pushed down into the shoreline. Furthermore, the one or more support members are positioned with their forward edge in front of the propeller by enough distance to catch or block most of the weeds that would otherwise confront and entangle the propeller. Two flanges with holes are incorporated into the one or more deflecting members or one or more support members and aligned on a plane perpendicular to the longitudinal axis of the watercraft. The flanges and holes accept a removable axle and pair of wheels. By easily attaching or removing the removable axle/wheel set, the propeller protection apparatus also offers the option of mobility to the craft on shore. Finally, the one or more deflecting members are shaped and positioned to establish elbows slightly behind the transom. The elbows are located so that they may balance the craft when placed vertically at rest upon its transom gunnel and/or hardware affixed to its transom gunnel.

The propeller protection apparatus requires very little in the way of operation. The two or more removable wheels and one or more removable axles may be inserted and attached, or detached, and removed. To use the vertical standing/storage position, the attachment of the two or more removable wheels makes the transition from horizontal to vertical orientation more convenient.

The invention makes it easy and convenient to solve four problems with a single system. The invention may also cause less hydrodynamic drag for the craft than other devices attempting to perform some of the duties of the invention.

The present invention provides a propeller protection apparatus surrounding a turnable propeller assembly operating beneath a bottom hull of a watercraft. The propeller protection apparatus includes: one or more deflecting members each independently coupled to the bottom hull of the watercraft, wherein the one or more deflecting members each independently having a first section, a second section, and a third section, wherein the one or more deflecting members each independently extend beyond a stern of the watercraft and below a lowest point of the turnable propeller assembly; one or more support members each independently coupled to the one or more deflecting members wherein the one or more support members are positioned in front of the propeller blade in the turnable propeller assembly; one or more removable axles each independently transversely coupled to each of the one or more deflecting members, wherein the one or more removable axles each independently having a first end and a second end; and two or more removable wheels each independently coupled to the first end and the second end of each of the one or more removable axles.

In one embodiment, the turnable propeller assembly turns around a vertical axis for steering the watercraft. In one embodiment, the turnable propeller assembly is powered by a battery.

In one embodiment, the first section of each of the one or more deflecting members each independently extend downward from the bottom hull of the watercraft forming an angle of less than ninety degrees to a plane of the bottom hull of the watercraft. In one embodiment, the second section of each of the one or more deflecting members each independently extends substantially parallel to the bottom hull of the watercraft. In one embodiment, the one or more deflecting members each independently allow the watercraft to be stored in a vertical position.

In one embodiment, the one or more support members are each independently transversely coupled to the one or more deflecting members. In one embodiment, the two or more removable wheels each independently allow the watercraft to be transported across land. In one embodiment, the one or more deflecting members, the one or more removable axles, or a combination thereof, are rod-like in shape.

In one embodiment, the one or more deflecting members, the one or more support members, the one or more removable axles, or a combination thereof, include one or more metals, one or more plastics, or a combination thereof. In one embodiment, the one or more deflecting members, the one or more support members, the one or more removable axles, or a combination thereof, each independently include a porous material to reduce drag resistance during movement of the watercraft through water.

In one embodiment, the two or more removable wheels each independently include a flexible balloon tire. In one embodiment, the two or more removable wheels each independently include a rigid tire. In one embodiment, the two or more removable wheels are each independently coupled to the one or more removable axles by one or more pins, one or more nuts, or one or more handles.

The present invention provides a propeller protection apparatus surrounding a turnable propeller assembly operating beneath a bottom hull of an electric-powered watercraft. The propeller protection apparatus includes: one or more deflecting members each independently coupled to the bottom hull of the electric-powered watercraft, wherein the one or more deflecting members each independently having a first section, a second section, and a third section, wherein the one or more deflecting members each independently extend beyond a stern of the electric-powered watercraft and below a lowest point of the turnable propeller assembly, wherein the second section of each of the one or more deflecting members each independently extend substantially parallel to the bottom hull of the electric-powered watercraft; one or more support members each independently transversely coupled to the one or more deflecting members wherein the one or more support members are positioned in front of the propeller blade in the turnable propeller assembly; one or more removable axles each independently transversely coupled to each of the one or more deflecting members, wherein the one or more removable axles each independently having a first end and a second end; and two or more removable wheels each independently coupled to the first end and the second end of each of the one or more removable axles; and wherein the turnable propeller assembly turns around a vertical axis for steering the electric-powered watercraft and is powered by a battery.

In one embodiment, the first section of each of the one or more deflecting members each independently extend downward from the bottom hull of the electric-powered watercraft forming an angle of less than ninety degrees to a plane of the bottom hull of the electric-powered watercraft. In one embodiment, the one or more deflecting members each independently allow the watercraft to be stored in a vertical position. In one embodiment, the two or more removable wheels each independently allow the electric-powered watercraft to be transported across land.

The present invention provides a propeller protection apparatus surrounding a turnable propeller assembly operating beneath a bottom hull of an electric-powered watercraft. The propeller protection apparatus includes: two deflecting members each independently coupled to the bottom hull of the electric-powered watercraft, wherein the two deflecting members each independently having a first section, a second section, and a third section, wherein the one or more deflecting members each independently extend beyond a stern of the electric-powered watercraft and below a lowest point of the turnable propeller assembly, wherein the first section of each of the two deflecting members each independently extend downward from the bottom hull of the electric-powered watercraft forming an angle of less than ninety degrees to a plane of the bottom hull of the electric-powered watercraft, wherein the second section of each of the two deflecting members each independently extend substantially parallel to the bottom hull of the electric-powered watercraft; a support member transversely coupled to the two deflecting members wherein the support member is positioned in front of the propeller blade in the turnable propeller assembly; one axle transversely coupled to each of the two deflecting members, wherein the one axle has a first end and a second end; and two removable wheels each independently coupled to the first end and the second end of the one axle; and wherein the turnable propeller assembly turns around a vertical axis for steering the electric-powered watercraft.

The present invention provides a watercraft. The watercraft includes: a watercraft including a turnable propeller assembly operating beneath a bottom hull; and a propeller protection apparatus surrounding a turnable propeller assembly including: one or more deflecting members each independently coupled to the bottom hull of the watercraft, wherein the one or more deflecting members each independently having a first section, a second section, and a third section, wherein the one or more deflecting members each independently extend beyond a stern of the watercraft and below a lowest point of the turnable propeller assembly; one or more support members each independently coupled to the one or more deflecting members, wherein the one or more support members are positioned in front of the propeller blade in the turnable propeller assembly; one or more removable axles each independently transversely coupled to each of the one or more deflecting members, wherein the one or more removable axles each independently having a first end and a second end; two or more removable wheels each independently coupled to the first end and the second end of each of the one or more removable axles, and a power source including one or more batteries each operatively coupled to the turnable propeller assembly to power the watercraft.

The present invention provides am electric-powered watercraft. The electric-powered watercraft includes: an electric-powered watercraft including a turnable propeller assembly operating beneath a bottom hull; and a propeller protection apparatus surrounding a turnable propeller assembly including: one or more deflecting members each independently coupled to the bottom hull of the electric-powered watercraft, wherein the one or more deflecting members each independently having a first section, a second section, and a third section, wherein the one or more deflecting members each independently extend beyond a stern of the electric-powered watercraft and below a lowest point of the turnable propeller assembly, wherein the second section of each of the one or more deflecting members each independently extend substantially parallel to the bottom hull of the electric-powered watercraft; one or more support members each independently transversely coupled to the one or more deflecting members, wherein the one or more support members are positioned in front of the propeller blade in the turnable propeller assembly; one or more removable axles each independently transversely coupled to each of the one or more deflecting members, wherein the one or more removable axles each independently having a first end and a second end; two or more removable wheels each independently coupled to the first end and the second end of each of the one or more removable axles; and a power source including one or more batteries each operatively coupled to the turnable propeller assembly to power the electric-powered watercraft.

The present invention provides am electric-powered watercraft. The electric-powered watercraft includes: an electric-powered watercraft including a turnable propeller assembly operating beneath a bottom hull; and a propeller protection apparatus surrounding a turnable propeller assembly including: two deflecting members each independently coupled to the bottom hull of the electric-powered watercraft, wherein the two deflecting members each independently having a first section, a second section, and a third section, wherein the one or more deflecting members each independently extend beyond a stern of the electric-powered watercraft and below a lowest point of the turnable propeller assembly, wherein the first section of each of the two deflecting members each independently extend downward from the bottom hull of the electric-powered watercraft forming an angle of less than ninety degrees to a plane of the bottom hull of the electric-powered watercraft, wherein the second section of each of the two deflecting members each independently extend substantially parallel to the bottom hull of the electric-powered watercraft; one support member transversely coupled to the two deflecting members, wherein the support member is positioned in front of the propeller blade in the turnable propeller assembly; one axle transversely coupled to each of the two deflecting members, wherein the one axle has a first end and a second end; two removable wheels each independently coupled to the first end and the second end of the one axle;

wherein the turnable propeller assembly turns around a vertical axis for steering the electric-powered watercraft; and a power source including one or more batteries each operatively coupled to the turnable propeller assembly to power the electric-powered watercraft.

BRIEF DESCRIPTION OF THE DRAWINGS

Embodiments of the invention may be best understood by referring to the following description and accompanying drawings, which illustrate such embodiments. In the drawings.

Figure 1:
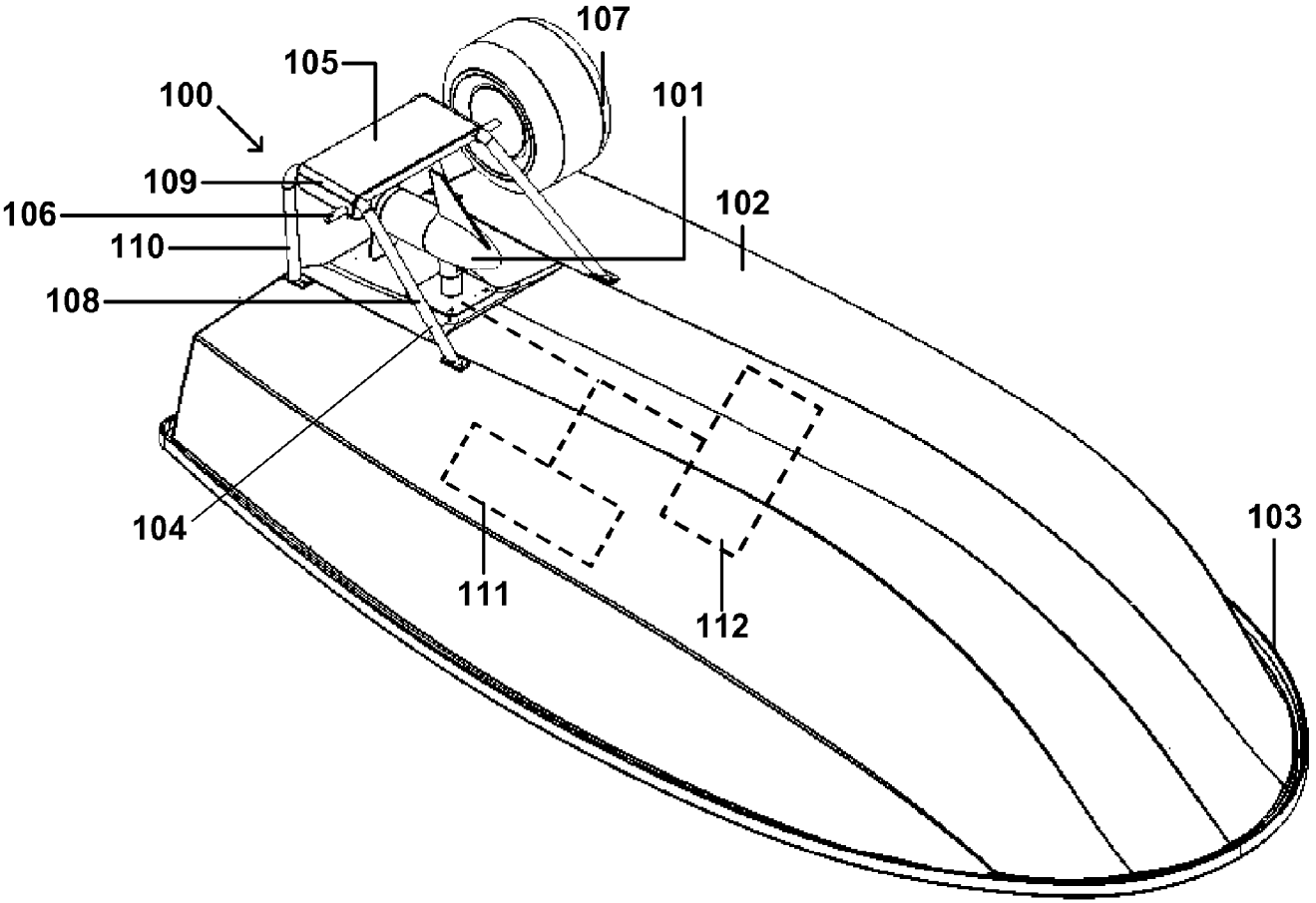
FIG. 1 is a perspective bottom view drawing illustrating an exemplary a propeller protection apparatus attached to the hull of a watercraft.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a propeller protection apparatus surrounding a turnable propeller assembly operating beneath a bottom hull of a watercraft. The propeller protection apparatus includes one or more deflecting members, each of which extend below the lowest point of the watercraft's propeller path. Affixed between the one or more deflecting members are one or more support members. The one or more deflecting members and the one or more support members act to prevent the propeller from being pushed down into the shoreline. Furthermore, the one or more support members are positioned with their forward edge in front of the propeller by enough distance to catch or block most of the weeds that would otherwise confront and entangle the propeller. Two flanges with holes are incorporated into the one or more deflecting members or one or more support members and aligned on a plane perpendicular to the longitudinal axis of the watercraft. The flanges and holes accept a removable axle and pair of wheels. By easily attaching or removing the removable axle/wheel set, the propeller protection apparatus also offers the option of mobility to the craft on shore. Finally, the one or more deflecting members are shaped and positioned to establish elbows slightly behind the transom. The elbows are located so that they may balance the craft when placed vertically at rest upon its transom gunnel and/or hardware affixed to its transom gunnel.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "cockpit" refers to the space on the deck where the user operates the helm.

As used herein, the term "deck" refers to the floor of a watercraft especially the upper, open level extending for the full length of the vessel. The deck may be a one-piece molded construction.

As used herein, the phrase "operatively coupled" refers to bringing two or more items together or into relationship with each other such that they may operate together or allow transfer of information between the two or more items.

As used herein, the phrase "fixed propeller" refers to propeller that has a shaft in fixed position and cannot be rotated underneath the hull to provide steering for the watercraft.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "propeller protection" refers to protecting the propeller and its assembly from damage by various methods such as collisions, entanglement, grounding, and the like.

As used herein, the phrase "turnable propeller assembly" refers to a propeller assembly in which a propeller in a horizontal plane. The assembly is mounted so that it can be turned around a vertical axis for steering a vessel, being located beneath, behind, at the bows, or to one or both sides of the vessel.

As used herein, the term "watercraft" refers to a vessel for transport by water, constructed to provide buoyancy by excluding water and shaped to give stability and to allow propulsion. Also as used herein, the watercraft may include a molded hull and a molded deck. The molded deck may include a molded cockpit.

As used herein, the term "electric-powered watercraft" refers to a watercraft that is powered by electricity. The source of the electricity may be a battery, a generator, solar panels, and the like.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
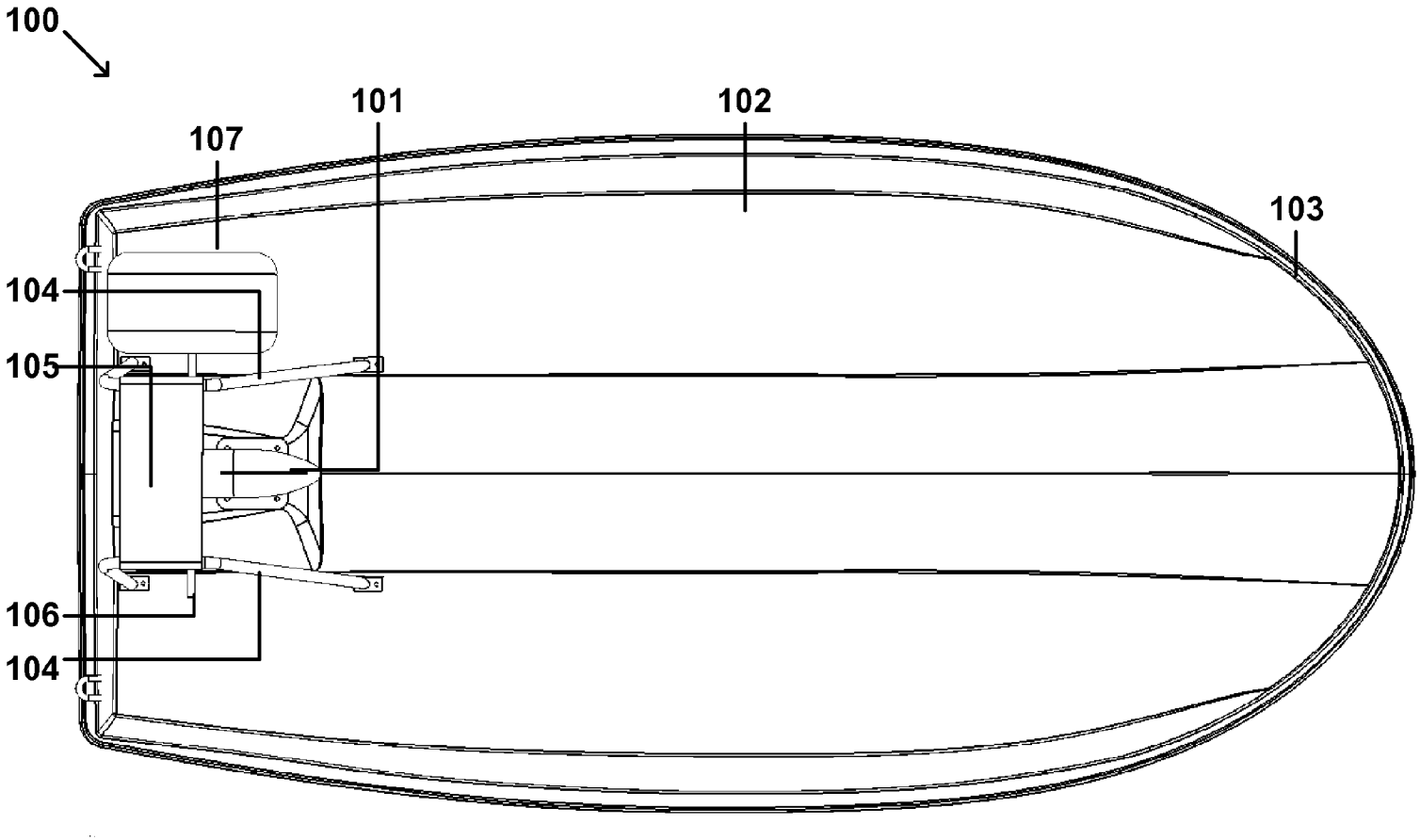
FIG. 2 is a bottom view drawing illustrating an exemplary a propeller protection apparatus attached to the hull of a watercraft.
Figure 3:
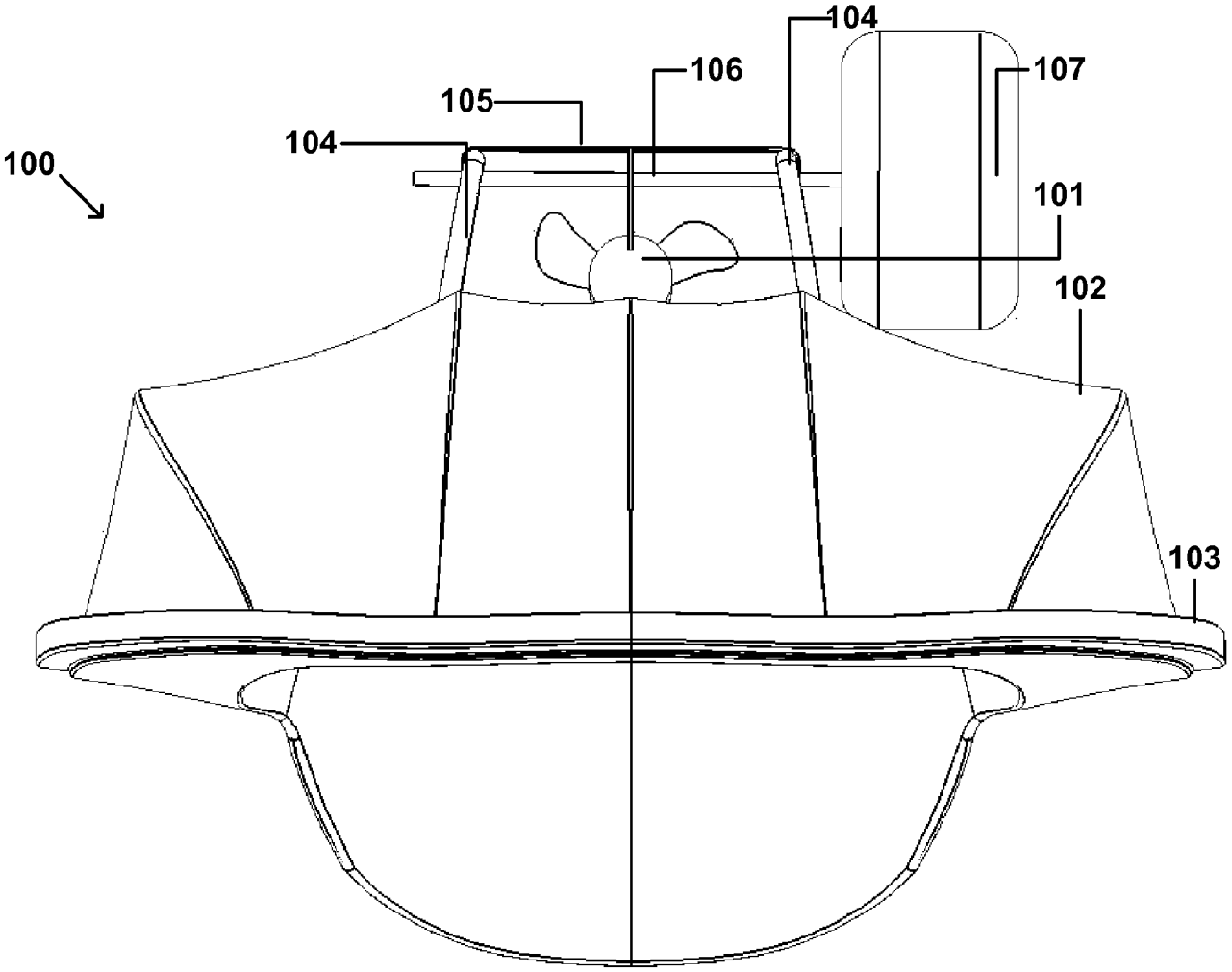
FIG. 3 is a front view drawing illustrating an exemplary a propeller protection apparatus attached to the hull of a watercraft.
Figure 4:
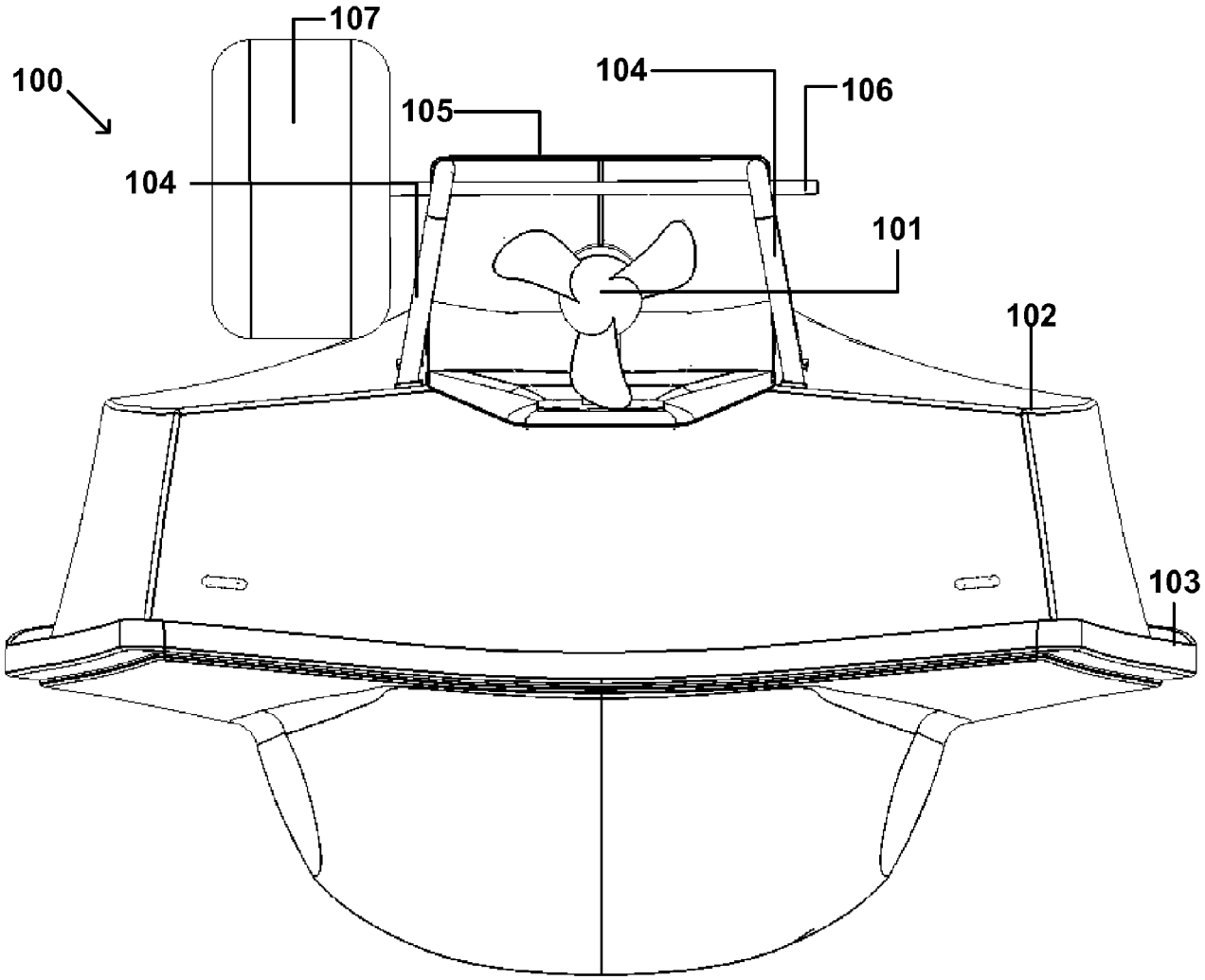
FIG. 4 is a rear view drawing illustrating an exemplary a propeller protection apparatus attached to the hull of a watercraft.
Figure 5:
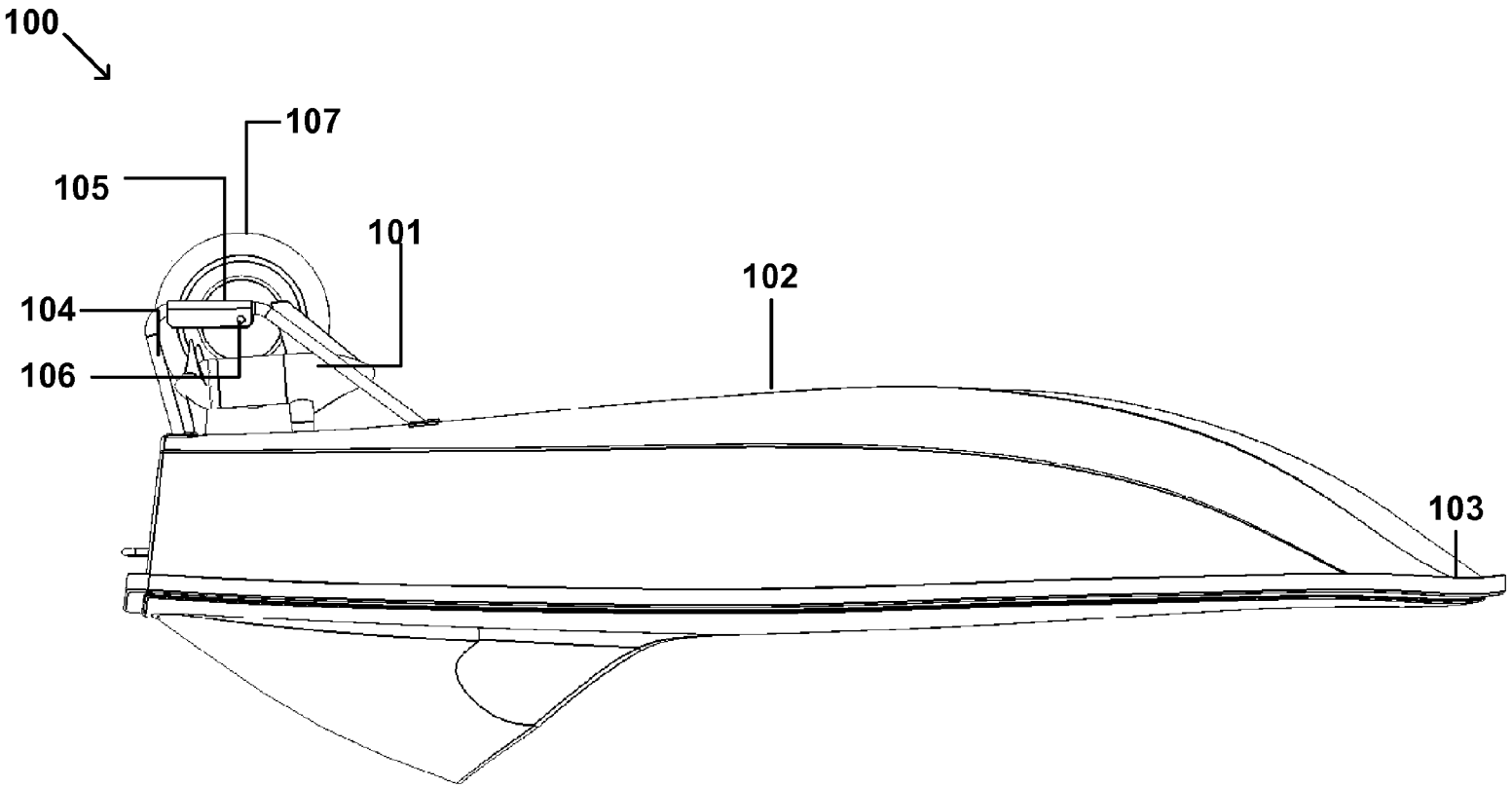
FIG. 5 is a side view drawing illustrating an exemplary a propeller protection apparatus attached to the hull of a watercraft.

FIGS. 1-5 are various drawings illustrating an exemplary propeller protection apparatus 100. The exemplary propeller protection apparatus 100 surrounds a turnable propeller assembly 101 operating beneath a bottom hull 102 of a watercraft 103. The exemplary propeller protection apparatus 100 includes two deflecting members 104, a support member 105, a removable axle 106, and two removable wheels 107. Although only one removable wheel 107 is shown for clarity, the typical embodiment includes two removable wheels 107. The deflecting members 104 are coupled to the bottom hull 102 of the watercraft 103. The two deflecting members 104 each independently have a first section 108, a second section 109, and a third section 110, which extends beyond a stern of the watercraft 103. The support member 105 is coupled to the two deflecting members 104. The removable axle 106 is transversely coupled to each of the two deflecting members 104. The removable axle 106 has a first end and a second end. The two removable wheels 107 are coupled to the first end and the second end of the removable axle 106.

The turnable propeller assembly 101 turns around a vertical axis that is perpendicular to the bottom of the hull 102 for steering the watercraft 103. The turnable propeller assembly 101 may be electric-powered and is operatively connected to the power source 111 and the helm 112. The power source 111 is typically one or more batteries. The two deflecting members 104, which each independently extend beyond the stern, allow the watercraft 103 to be stored in a vertical position. The first section 108 of each of the two deflecting members 104 extend downward from the bottom hull 102 of the watercraft 103 forming an angle of less than ninety degrees to a plane of the bottom hull 102 of the watercraft 103. The second section 109 of the two deflecting members 104 extends substantially parallel to the bottom hull 102 of the watercraft 103 and below the lowest point of the turnable propeller assembly 101. The supporting member 105 is transversely coupled to the two deflecting members 104. The two removable wheels 107 allow for the watercraft 103 to be transported across land. The two deflecting members 104 and axle 106 are rod-like, as shown.

The two deflecting members 104, the support member 105, and the removable axle 106 may be made of one or more metals. The two deflecting members 104, the support member 105, and the removable axle 106 may be also be made of a porous material to reduce drag resistance during movement of the watercraft 103 through water. The two removable wheels 107 may include a flexible balloon tire (as shown) for transporting across sand or may include a rigid tire for transporting across packed terrain. The two removable wheels 107 may be coupled to the removable axle 106 by one or more pins, one or more handles, or the like.

The present invention also provides a method of using a propeller protection apparatus 100 surrounding a turnable propeller assembly 101 operating beneath a bottom hull 102 of a watercraft 103. The method includes: providing a propeller protection apparatus 100 surrounding a turnable propeller assembly 101 operating beneath a watercraft 103 including: two deflecting members 104 each independently coupled to the bottom hull 102 of the watercraft 103, wherein the two deflecting members 104 having a first section 108, a second section 109, and a third section 110, wherein the one or more deflecting members 104 each independently extend beyond a stern of the watercraft 103 and below a lowest point of the turnable propeller assembly 101; the support member 105 coupled to the two deflecting members 105; the removable axle 106 transversely mounted to each of the two deflecting members 105, wherein the removable axle 106 has a first end and a second end; and two removable wheels 107 coupled to the first end and the second end of each of the removable axle 106; transporting the watercraft 103 on the two removable wheels 107 across land and into a body of water; removing the two removable wheels 107 and the removable axle 106; using the watercraft 103 in the body of water; beaching the watercraft 103 on the land; reattaching the two removable wheels 107 to the removable axle 106; transporting the watercraft 103 across land to a storage area; and positioning the watercraft 103 onto the stern and the propeller protection apparatus 100.

Figure 6:
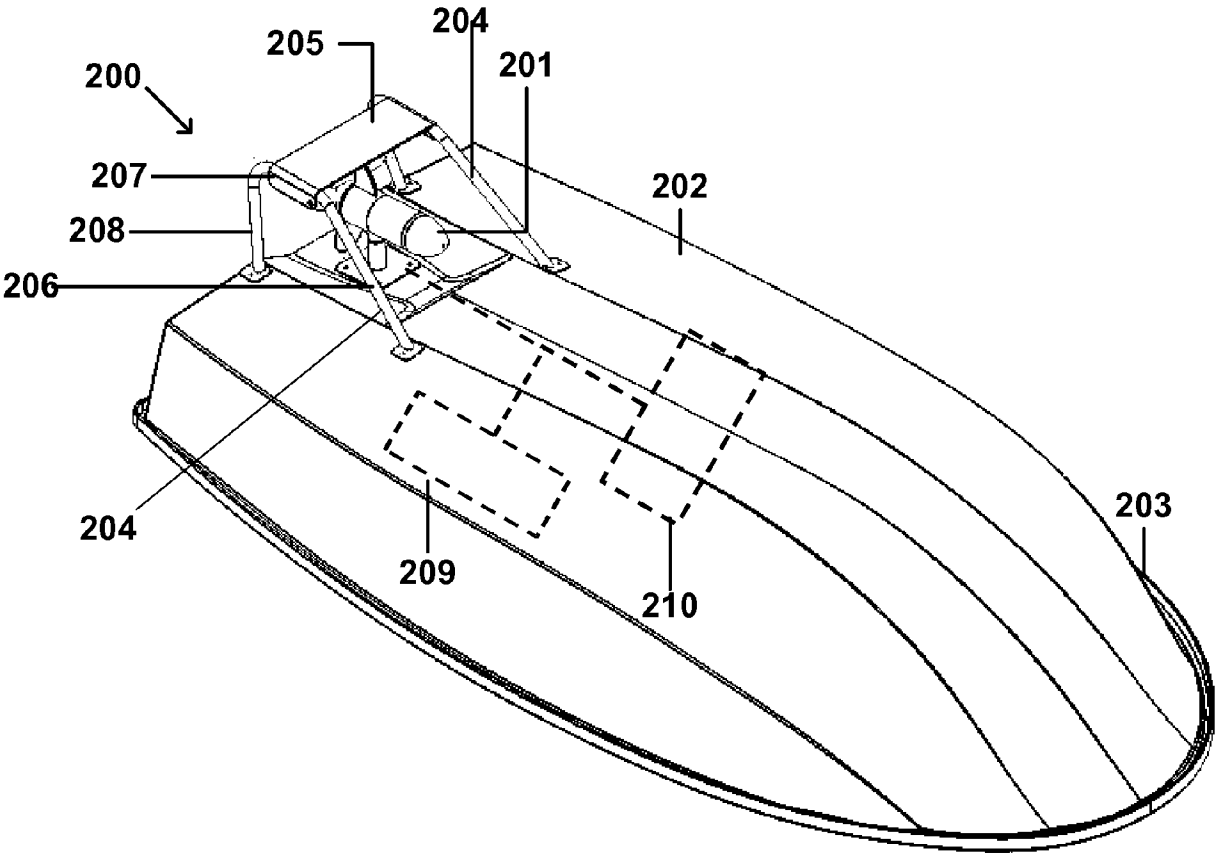
FIG. 6 is a perspective bottom view drawing illustrating an exemplary a propeller protection apparatus attached to the hull of a watercraft.
Figure 7:
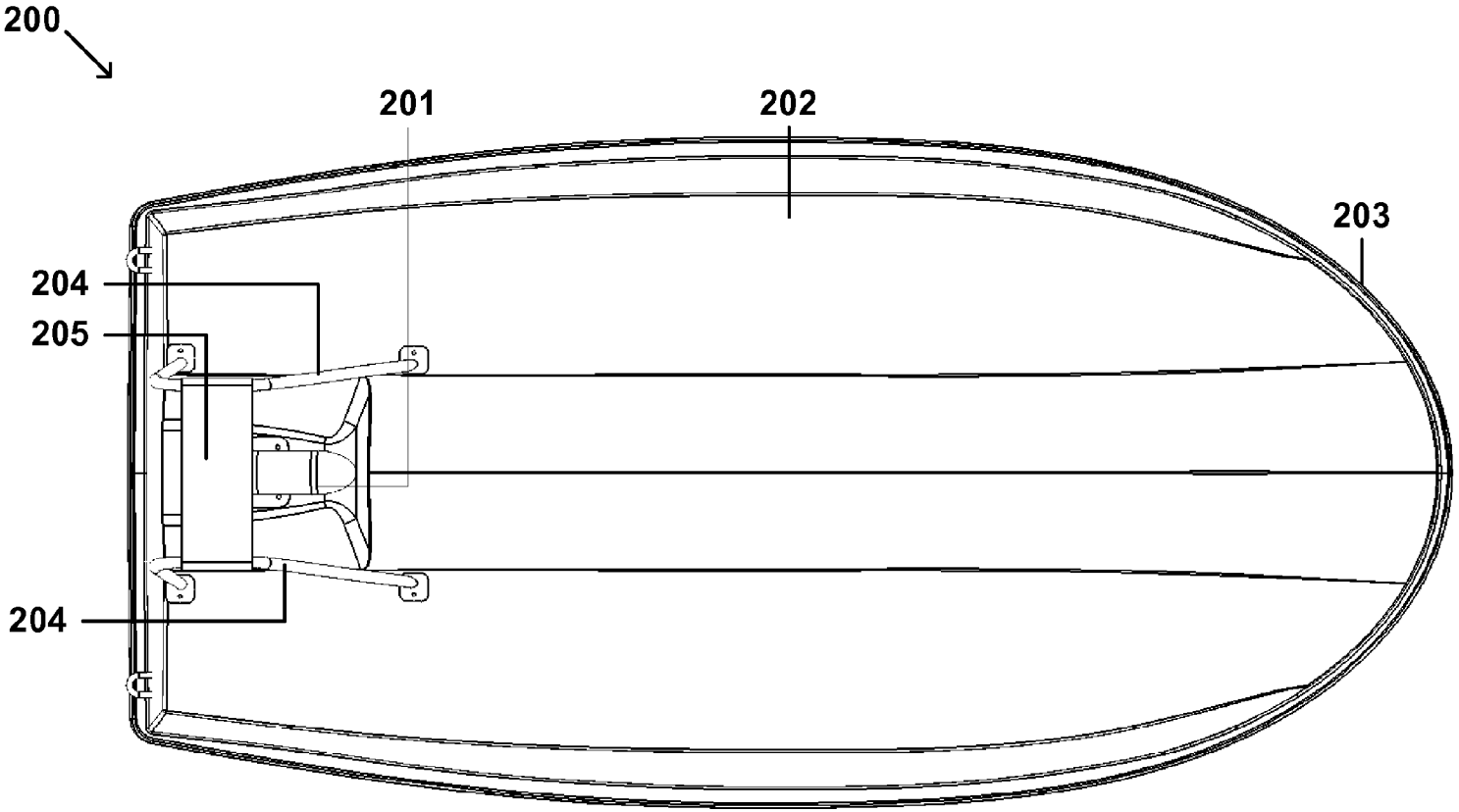
FIG. 7 is a bottom view drawing illustrating an exemplary a propeller protection apparatus attached to the hull of a watercraft.
Figure 8:
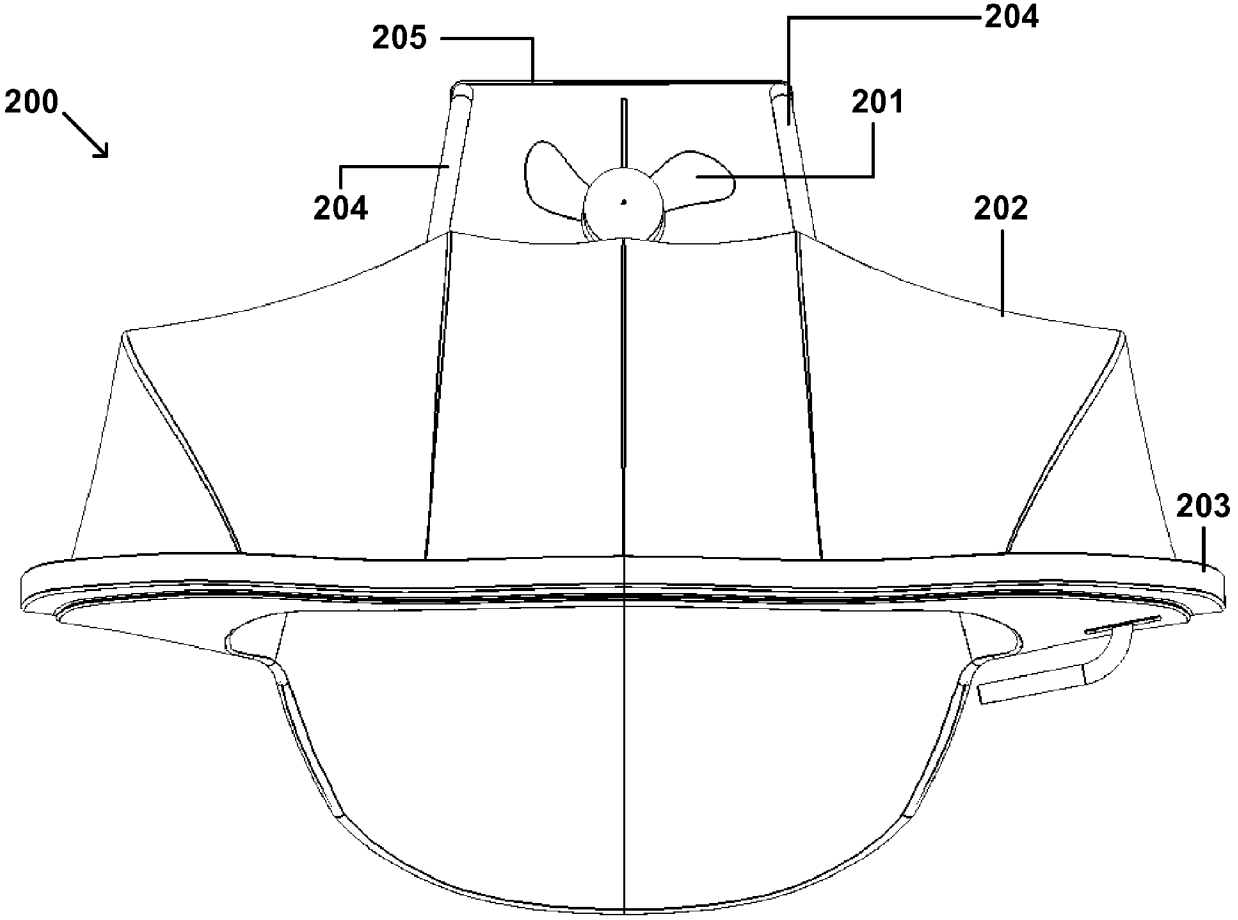
FIG. 8 is a front view drawing illustrating an exemplary a propeller protection apparatus attached to the hull of a watercraft.
Figure 9:
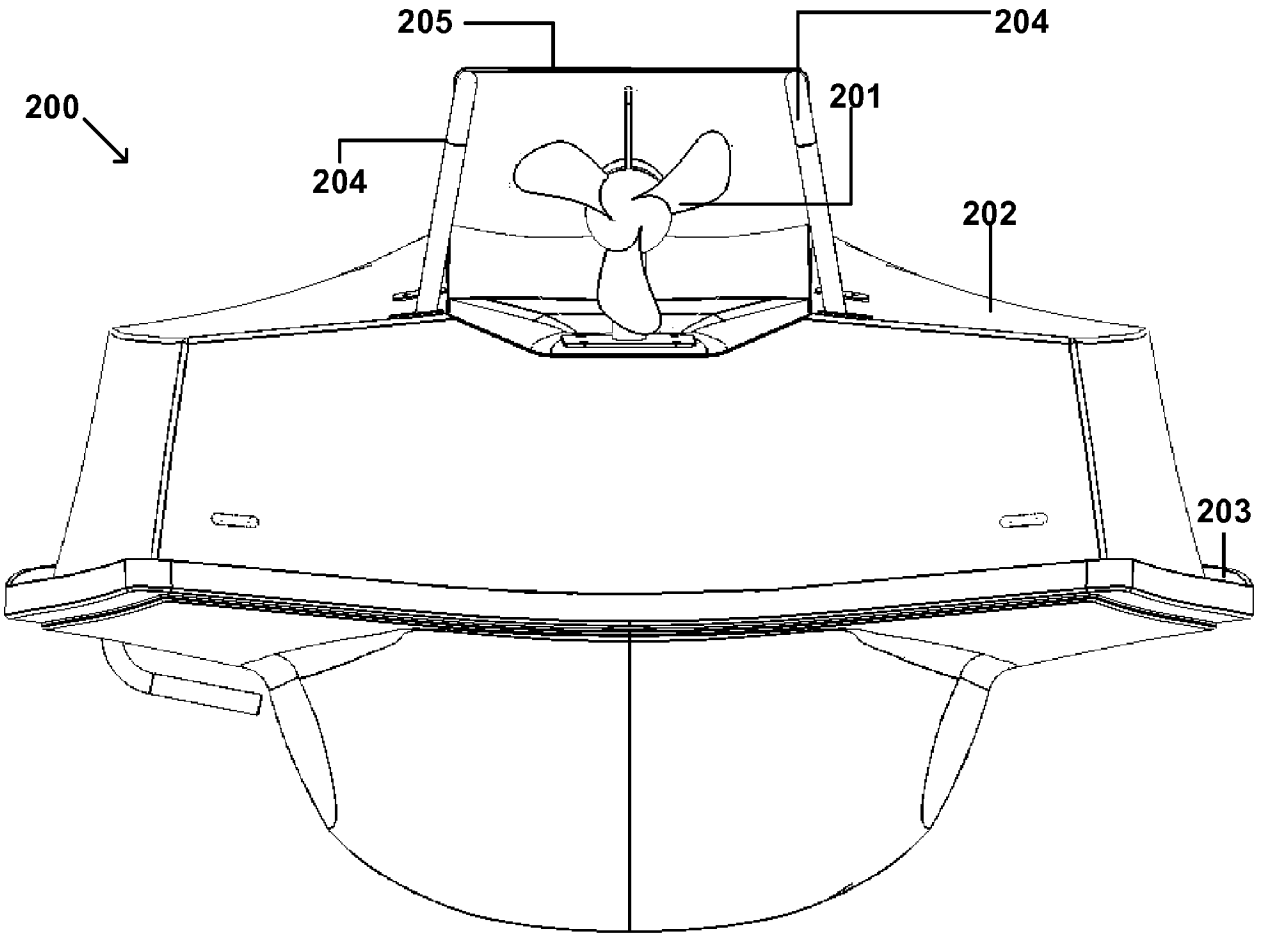
FIG. 9 is a rear view drawing illustrating an exemplary a propeller protection apparatus attached to the hull of a watercraft.
Figure 10:
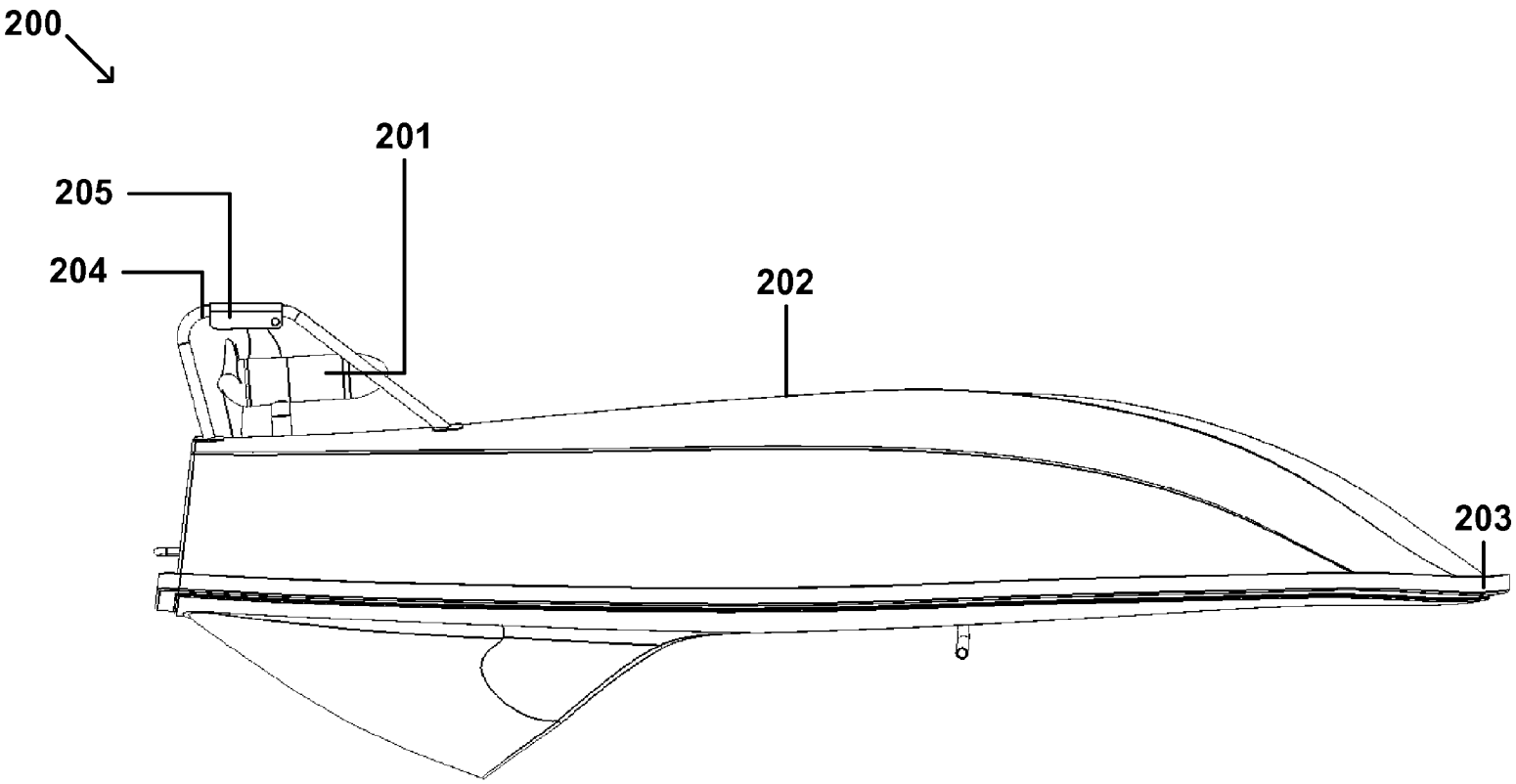
FIG. 10 is a side view drawing illustrating an exemplary a propeller protection apparatus attached to the hull of a watercraft.

FIGS. 6-10 are various drawings illustrating an exemplary propeller protection apparatus 200. The exemplary propeller protection apparatus 200 surrounds a turnable propeller assembly 201 operating beneath a bottom hull 202 of a watercraft 203, when the watercraft 203 is in the water. The exemplary propeller protection apparatus 200 includes two deflecting members 204 and the support member 205. The one axle (not shown) and two removable wheels (not shown) may be removed during the operation of the watercraft 203 in water to reduce the drag. The two deflecting members 204 are coupled to the bottom hull 202 of the watercraft 203. The two deflecting members 204 each have a first section 206, a second section 207, and third section 208, which extends beyond the stern of the watercraft 203. The support member 205 is transversely coupled to the two deflecting members 204. The one axle (not shown) is transversely coupled to each of the one or more deflecting members 204. The removed axle (not shown) has a first end (not shown) and a second end (not shown). The two or more removable wheels (not shown) are coupled to the first end (not shown) and the second end (not shown) of the removable axle (not shown). The turnable propeller assembly 201 may be electric-powered and is operatively connected to the power source 209 and the helm 210.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A propeller protection apparatus surrounding a turnable propeller assembly operating beneath a bottom hull of a watercraft comprising:

one or more deflecting members each independently coupled to the bottom hull of the watercraft, wherein the one or more deflecting members each independently having a first section, a second section, and a third section, wherein the second section of each of the one or more deflecting members each independently extend substantially parallel to the bottom hull of the watercraft, wherein the one or more deflecting members each independently extend beyond a stern of the watercraft and below a lowest point of the turnable propeller assembly;

one or more support members each independently coupled to the one or more deflecting members, wherein the one or more support members are positioned in front of a propeller blade in the turnable propeller assembly;

one or more removable axles each independently transversely coupled to each of the one or more deflecting members, wherein the one or more removable axles each independently having a first end and a second end; and two or more removable wheels each independently coupled to the first end and the second end of each of the one or more removable axles.

2. The propeller protection apparatus of claim 1, wherein the one or more deflecting members each independently allow the watercraft to be stored in a vertical position.

3. The propeller protection apparatus of claim 1, wherein the one or more deflecting members, the one or more support members, the one or more removable axles, or a combination thereof, each independently comprise a porous material to reduce drag resistance during movement of the watercraft through water.

4. A propeller protection apparatus surrounding a turnable propeller assembly operating beneath a bottom hull of an electric-powered watercraft comprising:

one or more deflecting members each independently coupled to the bottom hull of the electric-powered watercraft, wherein the one or more deflecting members each independently having a first section, a second section, and a third section, wherein the one or more deflecting members each independently extend beyond a stern of the electric-powered watercraft and below a lowest point of the turnable propeller assembly, wherein the second section of each of the one or more deflecting members each independently extend substantially parallel to the bottom hull of the electric-powered watercraft;

one or more support members each independently transversely coupled to the one or more deflecting members wherein the one or more support members are positioned in front of a propeller blade in the turnable propeller assembly;

one or more removable axles each independently transversely coupled to each of the one or more deflecting members, wherein the one or more removable axles each independently having a first end and a second end; and two or more removable wheels each independently coupled to the first end and the second end of each of the one or more removable axles.

5. The propeller protection apparatus of claim 4, wherein the one or more deflecting members each independently allow the watercraft to be stored in a vertical position.

6. The propeller protection apparatus of claim 4, wherein the first section of each of the one or more deflecting members each independently extend downward from the bottom hull of the electric-powered watercraft forming an angle of less than ninety degrees to a plane of the bottom hull of the electric-powered watercraft.

7. A propeller protection apparatus surrounding a turnable propeller assembly operating beneath a bottom hull of an electric-powered watercraft comprising:

two deflecting members each independently coupled to the bottom hull of the electric-powered watercraft, wherein the two deflecting members each independently having a first section, a second section, and a third section, wherein the one or more deflecting members each independently extend beyond a stern of the electric-powered watercraft and below a lowest point of the turnable propeller assembly, wherein the first section of each of the two deflecting members each independently extend downward from the bottom hull of the electric-powered watercraft forming an angle of less than ninety degrees to a plane of the bottom hull of the electric-powered watercraft, wherein the second section of each of the two deflecting members each independently extend substantially parallel to the bottom hull of the electric-powered watercraft;

one support member transversely coupled to the two deflecting members, wherein the support member is positioned in front of a propeller blade in the turnable propeller assembly;

one axle transversely coupled to each of the two deflecting members, wherein the one axle has a first end and a second end;

two removable wheels each independently coupled to the first end and the second end of the one axle; and wherein the turnable propeller assembly turns around a vertical axis for steering the electric-powered watercraft.

* * * * *